US012601254B1

(12) United States Patent
Nebiolo et al.

(10) Patent No.: US 12,601,254 B1
(45) Date of Patent: Apr. 14, 2026

(54) HYDRAULIC PULSE GENERATOR INTEGRATED INTO A DOWNHOLE MOTOR

(71) Applicant: UNIVERSAL COMPLETIONS LLC, Buenos Aires (AR)

(72) Inventors: Martin Mauro Nebiolo, Neuquen (AR); Christian Cerne, Spring, TX (US); Gustavo Dietrich, Neuquen (AR); Cristian Brendstrup, Neuquen (AR)

(73) Assignee: UNIVERSAL COMPLETIONS LLC, Buenos Aires (AR)

( * ) Notice: Subject to any disclaimer, the term of this patent is extended or adjusted under 35 U.S.C. 154(b) by 0 days.

(21) Appl. No.: 19/314,469

(22) Filed: Aug. 29, 2025

(51) Int. Cl.
*E21B 34/06* (2006.01)
*E21B 47/12* (2012.01)

(52) U.S. Cl.
CPC ..... *E21B 47/138* (2020.05); *E21B 34/06* (2013.01)

(58) Field of Classification Search
CPC ..... E21B 47/138; E21B 34/06
USPC ..... 175/40
See application file for complete search history.

(56) References Cited

U.S. PATENT DOCUMENTS 6,279,670 B1 8/2001 Eddison
6,439,318 B1 8/2002 Eddison
9,470,055 B2 10/2016 Harrigan
9,598,923 B2 * 3/2017 Gilleylen ..... E21B 7/24
9,915,107 B1 3/2018 Schultz
10,865,612 B2 * 12/2020 Elfar ..... E21B 21/103
10,968,721 B2 4/2021 Lorenson
11,365,586 B2 6/2022 Chambers
11,753,901 B2 9/2023 Schultz
11,927,073 B2 3/2024 Elfar
2012/0186878 A1 7/2012 Eddison
2020/0123856 A1 * 4/2020 Sicilian ..... E21B 31/005
2021/0277743 A1 * 9/2021 Schultz ..... E21B 47/20
2022/0397017 A1 * 12/2022 Elfar ..... E21B 31/005

FOREIGN PATENT DOCUMENTS

RU 2726805 C1 7/2020

* cited by examiner

*Primary Examiner* — Taras P Bemko
(74) *Attorney, Agent, or Firm* — Carter, DeLuca & Farrell LLP

(57) ABSTRACT

A hydraulic pulse generator integrated into a downhole motor is provided, consisting of a tubular assembly that coaxially integrates a pulse-generating section, a power section with a positive displacement Moineau-type hydraulic motor, and a bearing section. The pulse-generating section includes a rotary valve axially facing a stationary valve, both housed within a support sleeve and mounted on a lower carrier and an upper carrier. The rotary valve is directly connected to a flexible shaft provided with prismatic heads, coupled downstream to a bypass coupling provided with radial millings and a bypass nozzle. The bearing section incorporates radial bearings, axial bearings, an upper spacer, and a lower spacer, arranged to maintain alignment of the assembly. Modulation of the fluid passage between the valves and generates hydraulic pulses when directly driven by the flexible shaft.

9 Claims, 12 Drawing Sheets

HYDRAULIC PULSE GENERATOR INTEGRATED INTO A DOWNHOLE MOTOR

TECHNICAL FIELD OF THE INVENTION

The present invention discloses a hydraulic pulse generator integrated into a downhole motor, comprising a unified tool for drilling or well intervention operations using work string, whether composed of threaded pipe or coiled tubing. This development falls within the technical field of downhole devices aimed at optimizing tubing movement and the hydraulic efficiency of the operating assembly.

BACKGROUND

The present development falls within the field of equipment and methods for downhole operations, focusing on the generation of hydraulic pulses in workstrings. In various applications, it is beneficial to periodically or intermittently restrict or block fluid flow within the tubing, generating pulses that facilitate the advancement of the work string through vibration of the assembly, the production of a water hammer effect, and/or reduction of friction between the tubing and the wellbore wall.

Despite existing advancements, there remains a need for more efficient, integrated, and adaptable devices for various types of operations, such as drilling, intervention, stimulation, injection, and production. Currently, various methods and devices are known to induce flow variations through mechanical, hydraulic, or pneumatic mechanisms. However, most of them present limitations in control, durability, and ease of integration.

The generation of hydraulic pulses in downhole tools has been addressed through hydraulic motors, modulating valves, and vibratory mechanisms, yet the prior art does not consider the functional and structural integration of a pulse generator with the downhole motor into a single operational body.

Relevant prior art has been identified in connection with hydraulic pulse generators for downhole operations, including the following developments:

U.S. Ser. No. 11/753,901B2 discloses a fluid pulse generator comprising a hydraulic motor with a rotor driven by fluid flow and a variable flow restrictor arranged upstream, featuring a rotatable and longitudinally displaceable restricting element. This device may incorporate a flexible joint or a constant velocity joint between the restricting element and the rotor and uses rotary valves to modulate hydraulic pulses via parallel flow paths. This configuration presents a degree of mechanical complexity and pressure loss due to multiple flow paths In contrast, the proposed development integrates a downhole motor and a pulse-generating tool into a single body. The rotation of the rotor directly drives an internal rotary valve, eliminating the need for parallel flow paths, auxiliary valves, or additional control mechanisms. This functional integration reduces mechanical complexity, improves hydraulic efficiency, and lowers pressure drop in the bottom hole assembly.

A key difference is that, unlike the prior art design where the movable valve is located upstream of the fixed valve, the design proposed herein positions the rotary valve downstream, directly on the motor's output shaft. This arrangement eliminates the need for splined shafts, moving seals, and centering bushings, significantly reducing the overall length of the assembly and allowing the use of a flexible shaft instead of a constant velocity joint. The stationary valve, in turn, is mounted on a floating carrier with axial displacement capability, further simplifying the design.

Additionally, whereas the prior art proposes an external bypass through an annular space, the present development implements an internal bypass system via concentric orifices in both valves, simplifying geometry and improving flow efficiency. This approach not only reduces manufacturing costs by avoiding complex geometries and special materials but also enhances operational reliability and simplifies maintenance.

U.S. Pat. No. 6,439,318B1 discloses a downhole apparatus that combines a hydraulic motor with an axially movable flow-restricting device connected to a drill bit. The motor drives this restrictor to generate cyclic variations in fluid pressure, inducing an axial hammering motion on the drill bit. This hammering effect improves drilling efficiency but is not intended to reduce friction between the work string and the wellbore wall, nor does it provide functional integration within a single tool.

U.S. Pat. No. 6,279,670B1 discloses an apparatus comprising a Moineau-type positive displacement motor that drives a rotary valve for generating hydraulic pulses. The structure includes fixed and movable valve plates with aligned slots, and universal joints on the shaft. While it employs similar principles, it does not offer a unified structural integration, and the assembly remains modular. It also does not consider applications in well intervention tasks or the optimization of friction reduction in horizontal sections.

A critical structural difference is that, although this prior art also positions the movable valve downstream, it features an additional eccentric motion relative to the fixed valve. Such eccentricity introduces unpredictable variability in the overlap of the orifices between both valves, making it difficult to accurately configure the amplitude of the hydraulic pulse. In contrast, the proposed development absorbs the natural eccentricity of the Moineau rotor through a flexible shaft and a set of specifically arranged bearings, allowing both valves to operate concentrically, thereby achieving stable and repeatable pulse modulation.

Patent US20120186878A1 describes a down hole tool integrating a Moineau-type positive displacement motor with a rotary valve designed to actuate a hydraulic piston linked to an impact mass. The valve, coupled to the rotor of the motor, alternates fluid flow between upper and lower chambers of a cylinder, generating a reciprocating movement of the piston and consequently repeated impacts on a drill bit. The design enables switching between an active mode (impacting) and a passive mode (non-impacting) by hydraulically reconfiguring the position of the piston and drill bit.

However, this tool is specifically designed to generate mechanical impacts with an impact mass, and not to reduce friction through continuous hydraulic pulses on the drilling assembly. Unlike the proposed development, it does not provide a unified structure combining sustained hydraulic impulse and continuous advancement of the drilling assembly.

Furthermore, as in other prior art, the valve mechanism relies on the eccentric movement of the Moineau motor's rotor, which results in a radial displacement between the fixed and movable valve disks. This generates variable overlap between flow orifices, hindering precise modulation of pressure pulses. In contrast, the present development absorbs such eccentricity through a flexible shaft and a bearing assembly that ensures concentric coupling between both valves, thereby enabling more stable, predictable, and controlled generation of hydraulic pulses throughout the operation.

U.S. Pat. No. 9,470,055B2 discloses a device for inducing mechanical oscillations through a slider driven by a drive shaft, which generates vibrations in various directions. Although it aims to improve efficiency and free stuck tools, it does not address the integrated generation of hydraulic pulses nor the reduction of friction through flow modulation, both of which are key aspects of the present development.

Patent RU2726805C1 reveals a vibrating tool that generates flow pulsations by means of a helical motor and valve discs with axial and radial channels. Although it shares general objectives such as friction reduction and flow improvement, it does so by using a complex architecture involving multiple chambers and moving components. The proposed development, in contrast, dispenses with these elements, employing simple valves and a compact structure.

U.S. Pat. No. 9,915,107B1 describes a tool with vortex chambers arranged in parallel, generating pulses through the formation of opposing vortices. While it provides an efficient solution for narrow environments, it does not integrate the motor and pulse generator into a single body, nor is it designed for adaptation to horizontal or difficult-to-reach wellbores by reducing friction.

U.S. Ser. No. 11/927,073B2 proposes a pulsing valve with oscillating and fixed heads actuated by pressure. This mechanism generates controlled pulses but relies on springs and mandrels, which adds mechanical complexity. The present development avoids such components, achieving pulse generation directly from the motor's drive shaft.

U.S. Ser. No. 11/365,586B2 discloses a steering system for a drill string that includes a rotary valve and flow channels designed to actuate hydraulic pistons. While it applies similar hydraulic control principles, it does not address continuous pulse generation nor structural integration into a single tool.

Finally, U.S. Ser. No. 10/968,721 B2 describes an assembly with a variable choke composed of rotary and stationary components actuated by a Moineau motor. Although it generates hydraulic pulses through a rotary valve driven by the rotor, it does not integrate multiple functions into a single body, nor does it consider friction reduction as a primary function—as the present development does.

Collectively, this detailed analysis of the prior art reveals that, although some developments place rotary valves downstream of the hydraulic motor—such as in U.S. Pat. No. 6,279,670B1, where the movable valve is positioned below the fixed one-none of them provides a configuration in which the valve is concentrically coupled to the motor's output shaft, moving seals, or constant velocity joints. The architecture proposed herein enables a significant reduction in the overall length of the assembly, facilitates the use of a flexible shaft, incorporates an efficient internal bypass system, and avoids complex geometries or costly components. This development captures the benefits of concentric movement between the valves but achieves it more simply than in U.S. Ser. No. 11/753,901 B2.

As a result, a technological gap is clearly identified, justifying the development of an innovative, compact, and functionally integrated solution aimed at optimizing hydraulic efficiency, reducing mechanical complexity, and enhancing performance in drilling or intervention operations-particularly in horizontal or extended-reach well trajectories. This device facilitates handling, increases reliability in down hole tasks, and represents a substantial technical advancement over the known prior art.

SUMMARY

The present invention relates to a hydraulic pulse generator integrated with a downhole motor, configured as a unified tool for operations using work string tubing. The device structurally combines a positive displacement hydraulic motor, the rotor of which directly drives a rotary valve axially opposed to a stationary valve. The interaction between both valves, arranged in a concentric assembly, modulates fluid flow and generates hydraulic pulses. This integrated configuration reduces friction between the work string and the borehole wall, optimizing movement along horizontal or geometrically complex trajectories. Furthermore, it contributes to minimizing pressure drop, simplifying the operational assembly, and ensuring reliable performance under severe downhole conditions.

In embodiments, a hydraulic pulse generator integrated into a downhole motor is provided including a unified tubular body, a power section with a positive displacement Moineau-type hydraulic motor, a bearing section, and a pulse-generating section arranged coaxially and upstream of the power section, all interconnected by a flexible shaft, in which the concentric, face-to-face arrangement of a rotary valve and a stationary valve, driven directly by the flexible shaft, produces a variable fluid passage, thereby generating hydraulic pulses, wherein the pulse-generating section comprises a stationary valve housed within an upper carrier, facing a rotary valve mounted concentrically and fixedly in a lower carrier, the rotary valve being located downstream of the stationary valve, and wherein the rotary valve is directly connected to the flexible shaft through an intermediate adapter, such that the valves and remain face-to-face and rotate concentrically relative to each other, being driven by the flexible shaft without interposition of intermediate moving elements, forming a coaxial, compact, and structurally integrated assembly.

The device enables the controlled generation of pressure pulses during fluid circulation, significantly reducing friction between the work string and the wellbore wall, in both open-hole and cased-hole environments. This functionality translates into enhanced advancement capability in horizontal or complex-geometry trajectories, lower overall pressure drop, and general simplification of the bottom hole assembly.

A novel technical solution is presented, based on a structurally integrated architecture that replaces more complex and fragmented traditional configurations, providing substantial advantages in reliability, performance, and design. The invention meets the requirements of novelty and inventive step, justifying its protection by means of a patent.

BRIEF DESCRIPTION OF THE DRAWINGS

To illustrate the advantages briefly mentioned above—along with many others that will become apparent to those skilled in the art—and to facilitate the understanding of the structural, constitutive, and functional features of the invented device, a preferred embodiment is described below. Said embodiment is illustrated schematically and not to scale in the accompanying drawings. It is expressly noted that, being merely an example, it should not be construed as limiting or exclusive with respect to the scope of protection of the present invention, but rather as an explanatory and illustrative representation of the basic concept on which the invention is founded.

DETAILED DESCRIPTION OF THE INVENTION

The present invention relates to a hydraulic pulse generator integrated with a downhole motor, designed as a unified tool for drilling or well intervention operations. The device combines, within a single body, a positive displacement motor and a hydraulic pulse-generating unit, structurally integrated with the purpose of reducing friction between the work string and the borehole wall, particularly in horizontal or extended-reach trajectories. This architecture enables optimized movement of the tubing through the periodic generation of pressure pulses while maintaining a continuous fluid flow, thereby eliminating the need for separate tools, simplifying the mechanical design, and improving operational efficiency.

Figure 1:
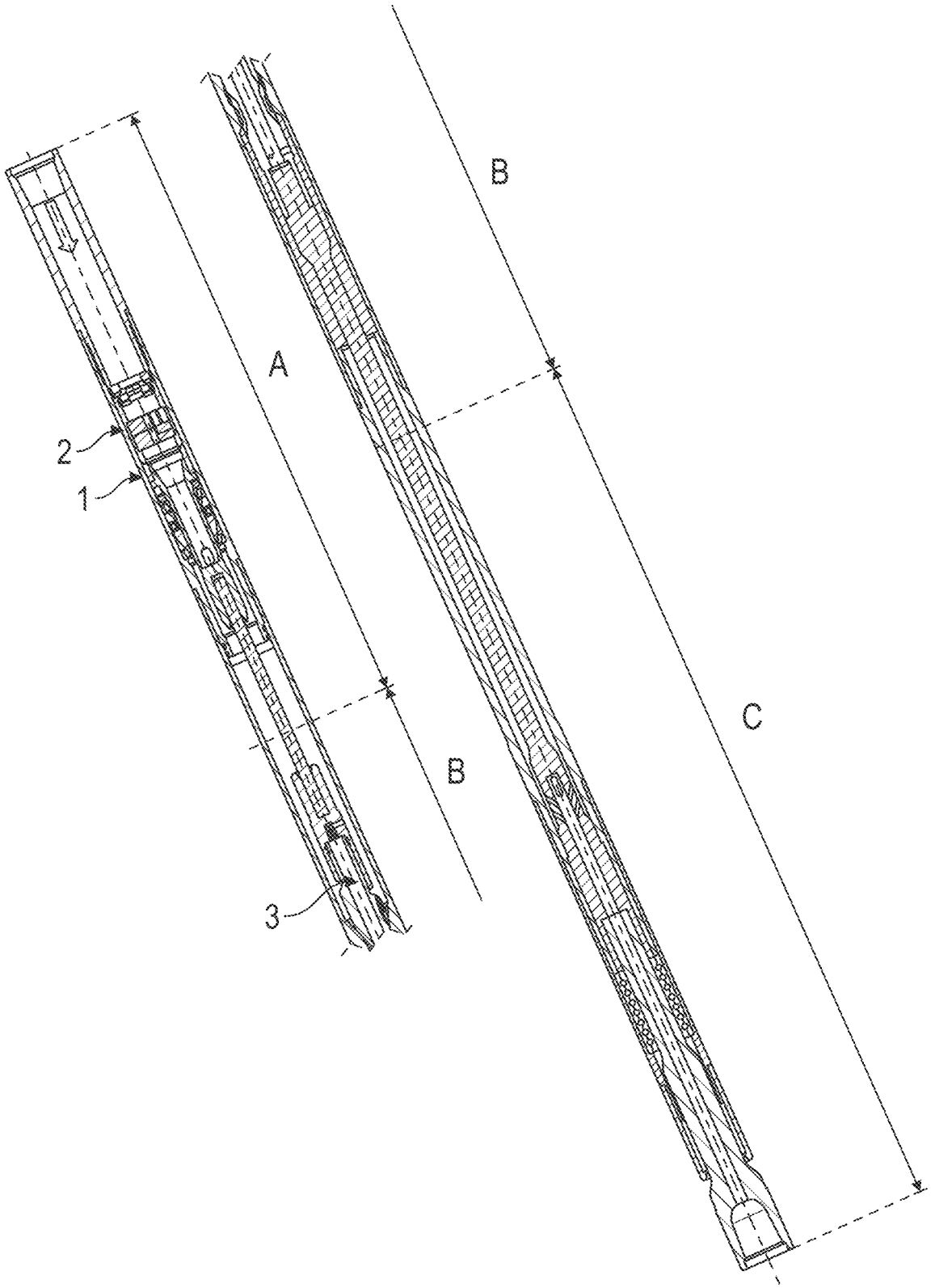
FIG. 1 is a longitudinal sectional view of the complete device of the present invention, according to a dimensional embodiment thereof.

FIG. 1 shows a longitudinal sectional view of the unified tool, structured in three main functional sections: a pulse-generating section (A), comprising a rotary valve (1) axially opposed to a stationary valve (2); a power section (B), housing a Moineau-type positive displacement motor (3) responsible for converting the hydraulic energy of the fluid into continuous rotary motion; and a bearing section (C), which provides guidance and support, absorbing axial and radial loads generated during operation.

During operation, fluid flows from the surface to the bottom through the device, passing through the pulse-generating section (A), where it interacts with the valves. The alternating alignment between the valves modulates the flow and produces hydraulic pulses. The fluid is then diverted to the power section (B), where it drives the helical rotor of the motor (3), whose rotation is transmitted upward to the rotary valve (1), maintaining the pulse sequence. This compact and integrated configuration enables the generation of hydraulic pulses that facilitate the movement of the work string, particularly in horizontal or extended-reach trajectories, reducing friction against the borehole wall and enhancing operational efficiency.

Figure 2:
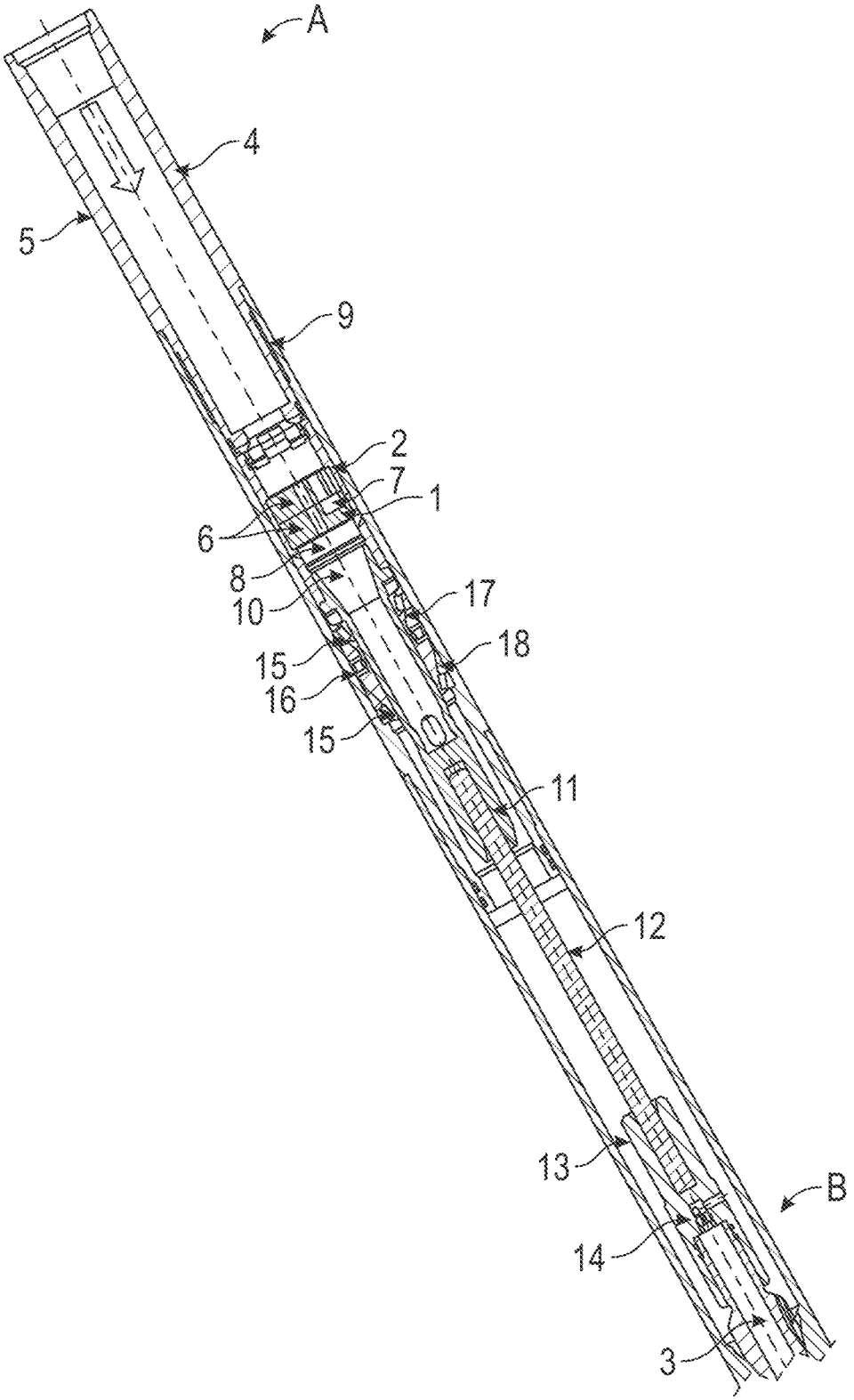
FIG. 2 is an enlarged longitudinal sectional view of the pulse-generating section of the device, according to a dimensional embodiment thereof.

FIG. 2 shows an enlarged longitudinal sectional view of the pulse-generating section (A), located upstream of the power section (B). The assembly is housed within a support sleeve (4), which serves as the structural carrier and guide of the device. At its upper end, there is a top adapter (5), designed to connect with external components of the bottom hole assembly. Internally, a stationary valve (2) is mounted, provided with a central axial bore (6) and a lateral flow port (7), aligned with a rotary valve (1), also featuring an axial bore (6) and a set of complementary flow ports (7). The rotary valve (1) is coupled at its outer circular surface to the interior of the lower carrier (8), from which it receives rotary motion. During operation, the angular interaction between the flow ports of both valves alternates between a fully open and a restricted condition, thereby modulating the fluid flow through them. This alternation generates periodic hydraulic pulses that induce a controlled water-hammer effect within the circulating fluid column.

The valve assembly, composed of the stationary valve (2) and the rotary valve (1), is axially retained between a non-rotating upper carrier (9), which supports the stationary valve (2) from its exterior, and a lower carrier (8), which connects the rotary valve (1) to a frustoconical adapter (10). This adapter features a cavity (11) at its opposite end designed to house a flexible shaft (12), which is in turn connected at its opposite end to a bypass coupling (13) rotationally driven by the Moineau motor (3), mechanically linking the power section (B) with the pulse section (A).

The fluid is then diverted through a bypass nozzle (14), which channels a portion of the flow into an internal passage within the rotor (3).

The inner diameter of the nozzle (14) allows regulation of the diverted fluid volume, and thus adjustment of the motor's (3) rotational speed.

This alignment is complemented by radial bearings (15) and axial bearings (16), arranged to absorb the operational loads generated during use. The upper spacer (17) and lower spacer (18) form part of the bearing assembly and are designed to continuously transmit axial and radial loads between adjacent components, ensuring structural stiffness of the assembly.

The final position of the lower carrier (8) and the rotary valve (1) is determined by the total assembly length down to the rotor, while zero axial gap between the valves (1, 2) is achieved through the axial adjustment of the upper carrier (9) during assembly.

This structurally integrated and compact configuration allows efficient hydraulic pulse generation without flow interruption, contributing to reduced friction between the work string and borehole wall, especially in horizontal or hard-to-reach well trajectories.

Figure 3:
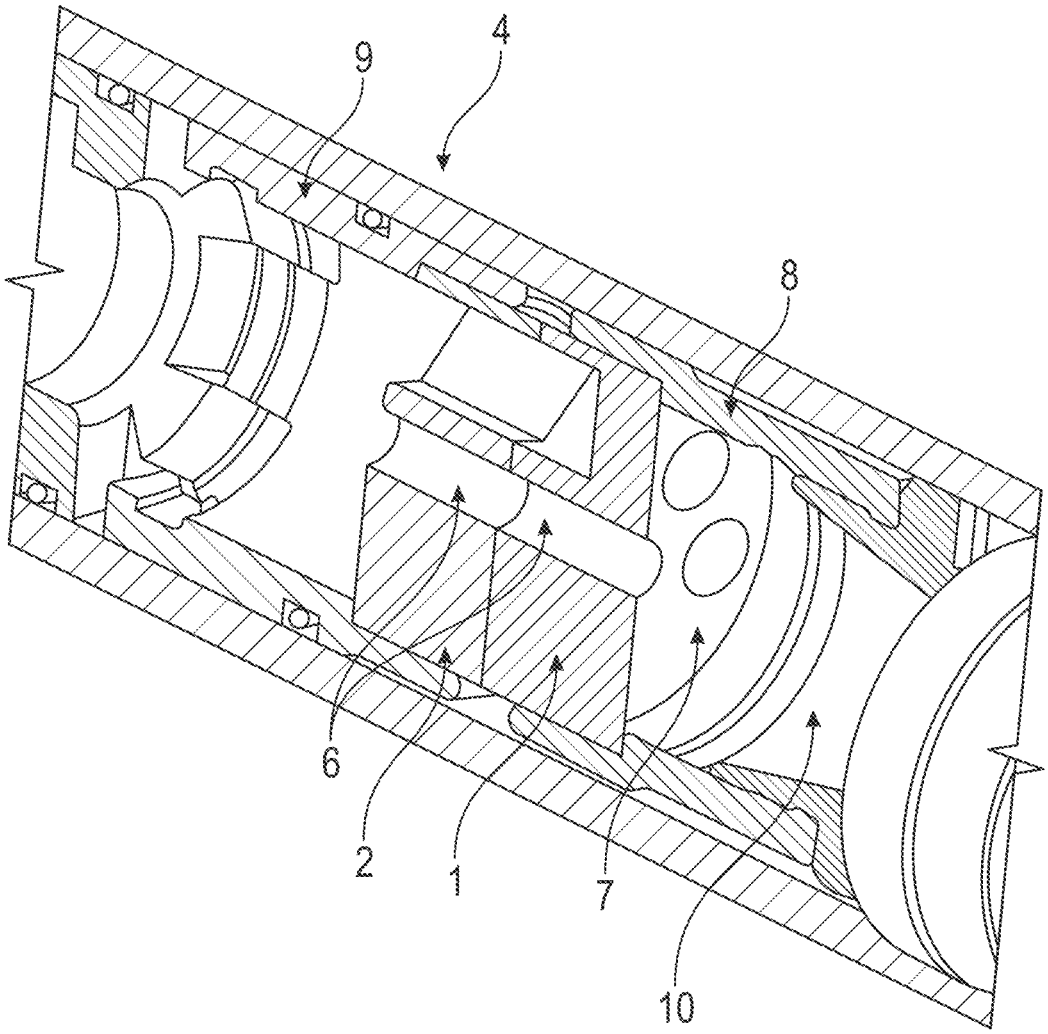
FIG. 3 is a detailed isometric view of the valve assembly of the present invention, according to a dimensional embodiment thereof.

FIG. 3 presents a detailed isometric view of the valve section housed within the support sleeve (4), where the static upper carrier (9) is shown holding the stationary valve (2) internally. The axial bore (6) of this valve aligns with that of the rotary valve (1), which is secured to the lower carrier (8) and receives torque from the frustoconical adapter (10), through which the fluid continues toward the power section (B).

Figure 4:
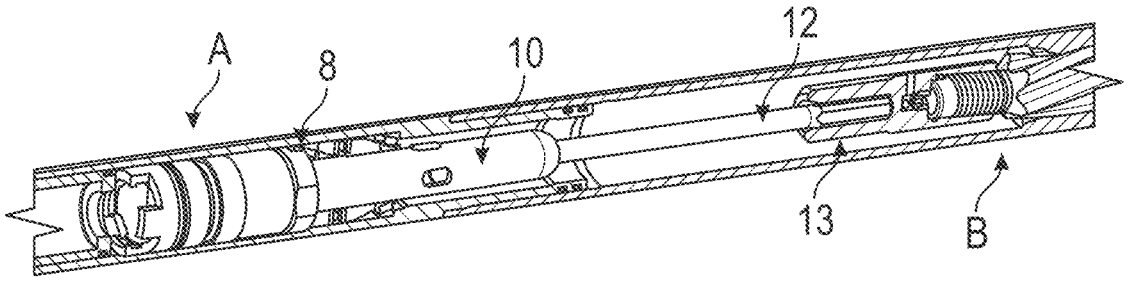
FIG. 4 is a longitudinal sectional view of the intermediate assembly between the pulse-generating section and the motor section of the device, according to a dimensional embodiment thereof.

FIG. 4 illustrates a sectional view of the intermediate assembly between the pulse-generating section (A) and the power section (B), highlighting the frustoconical adapter (10) as a key structural and functional connecting component. This adapter (10) channels the fluid by coupling upstream to the lower carrier (8) of the pulse section (A) and downstream to the flexible shaft (12), via the bypass coupling (13), ensuring torque transmission, structural alignment, and hydraulic continuity of the assembly.

Figure 5:
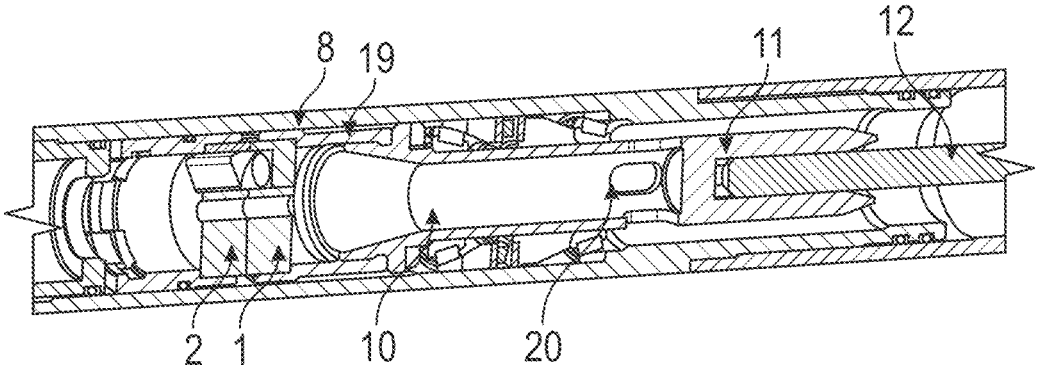
FIG. 5 is a longitudinal sectional view of the intermediate adapter of the present invention, according to a dimensional embodiment thereof.

FIG. 5 shows a longitudinal sectional view of the coupling between the valve assembly and the flexible shaft (12) through the adapter (10), which features a threaded surface (19) at its proximal end, designed to engage with the lower carrier (8). At its distal end, the adapter (10) includes a square-base prismatic cavity (11), configured to house the end of the flexible shaft (12), which has a complementary rectangular termination with a hemispherical tip. This geometry enables a semi-rigid connection that tolerates minor axial and angular misalignments without compromising torque transmission or assembly integrity while allowing fluid to flow through lateral circulation ports (20).

This design reduces the likelihood of cyclic fatigue failures found in other models, particularly those associated with configurations incorporating integral flexible shafts or mechanical constant-velocity joints composed of multiple rolling components and connections that are prone to wear or breakage. Additionally, as a non-integral connection, it allows for limited axial play and avoids critical stress concentrations at diameter transition areas, especially at the shaft ends.

Figure 6:
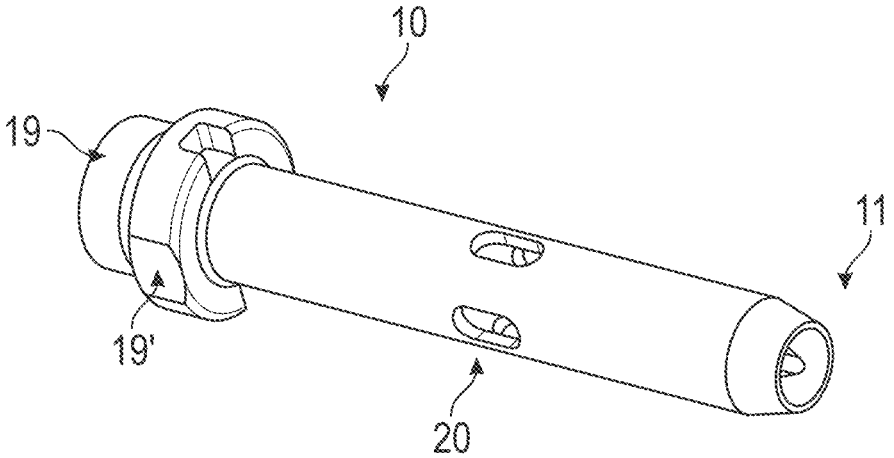
FIG. 6 is an isometric view of the intermediate adapter of the present invention, according to a dimensional embodiment thereof.

FIG. 6 shows an isometric view of the adapter (10). The adapter (10) comprises a cylindrical tubular body featuring an external thread (19) at one end, intended for threaded engagement with the lower carrier (8). Adjacent to the thread (19), the adapter (10) includes a driving flat (19'), formed as a lateral recess to accommodate a specialized wrench, enabling threaded engagement and disengagement without damaging the threaded surface.

The adapter's (10) tubular body also includes several radially distributed flow ports (20), allowing fluid to pass from the adapter's (10) internal central channel to the external periphery, directly supplying the power section (B) of the hydraulic motor.

At its non-threaded end, the adapter (10) features a coupling cavity (11), configured to receive and secure the square-end of the flexible shaft (12), ensuring direct torque transmission between the components without requiring intermediate moving parts. This configuration ensures structural integrity and facilitates both assembly and disassembly of the system.

Figure 7:
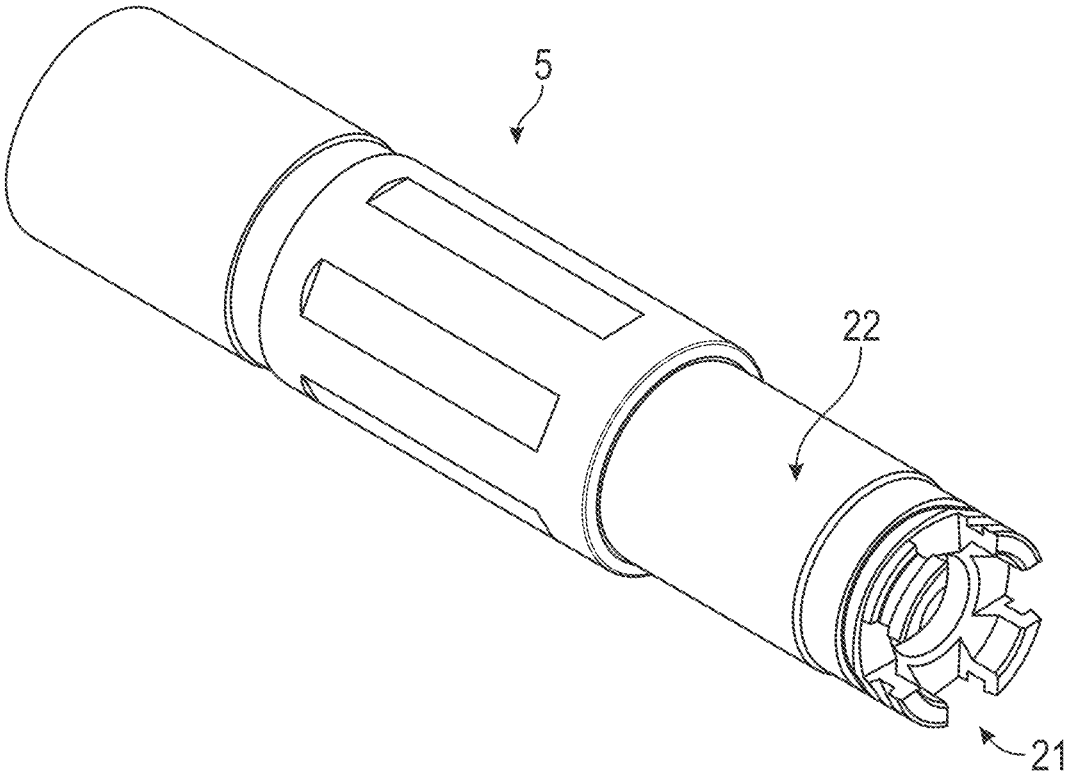
FIG. 7 is an isometric view of the upper adapter of the device of the present invention, according to a dimensional embodiment thereof.
Figure 7:
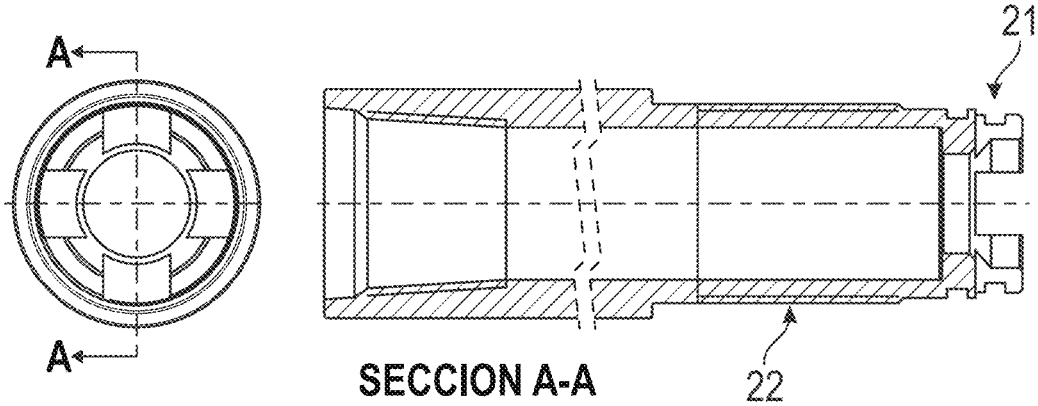

FIG. 7 shows an isometric view of the upper adapter (5), a tubular component designed to establish the threaded connection between the downhole device and the upper components of the operating assembly. This component features a robust cylindrical geometry, with a nose section formed by radial milling into orthogonally arranged castellations (21), configured to engage with the upper carrier (9), preventing it from rotating together with the rotary valve (1) during operation, without restricting its axial displacement, which is essential to ensure that both valves remain in contact The upper adapter (5) also incorporates an external thread (22) at its lower end, as shown in greater detail in the A-A sectional view, allowing its engagement with the support sleeve (4). This configuration ensures secure axial and torsional load transmission while maintaining the hydraulic continuity of the fluid throughout the device.

Figure 8:
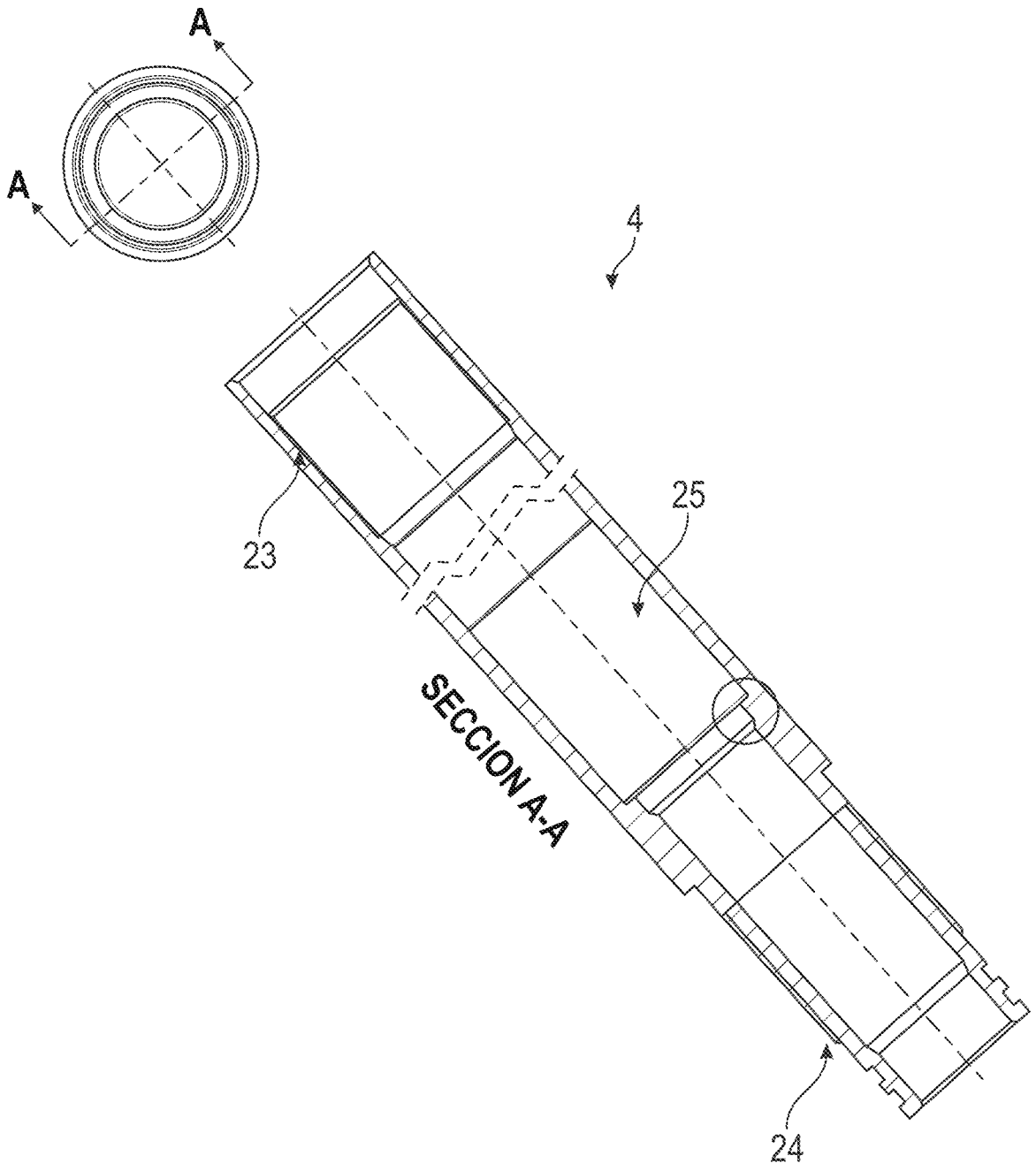
FIG. 8 is a longitudinal sectional view of the support sleeve of the present invention, according to a dimensional embodiment thereof.

FIG. 8 illustrates, in a longitudinal sectional view, the support sleeve (4), which constitutes the main body housing the pulse-generating section (A) It is a thick-walled cylindrical tubular structure designed to accommodate and coaxially align the valve assembly.

The sleeve (4) has, at its proximal end, an internal thread (23) configured to receive the external thread (22) of the upper adapter (5), ensuring a robust and leak-tight threaded connection. At its distal end, it has an externally threaded male portion (24) intended for direct connection to the stator of the downhole motor (3). This area includes machined peripheral grooves for sealing elements that ensure hydraulic tightness and reinforce the mechanical stability of the connection.

Internally, a cylindrical bore (25) of calibrated diameter serves as a guide for the coaxial arrangement of the upper and lower carriers (8) and (9) and the valve assembly. This bore (25) is precision-machined to ensure effective centering and uniform load transfer.

Overall, the support sleeve (4) functions as a key structural component of the device, providing mechanical support, axial alignment, and external protection for the valve assembly. Its design ensures both structural integrity and continuity of hydraulic flow through the pulse generator (A).

Figure 9:
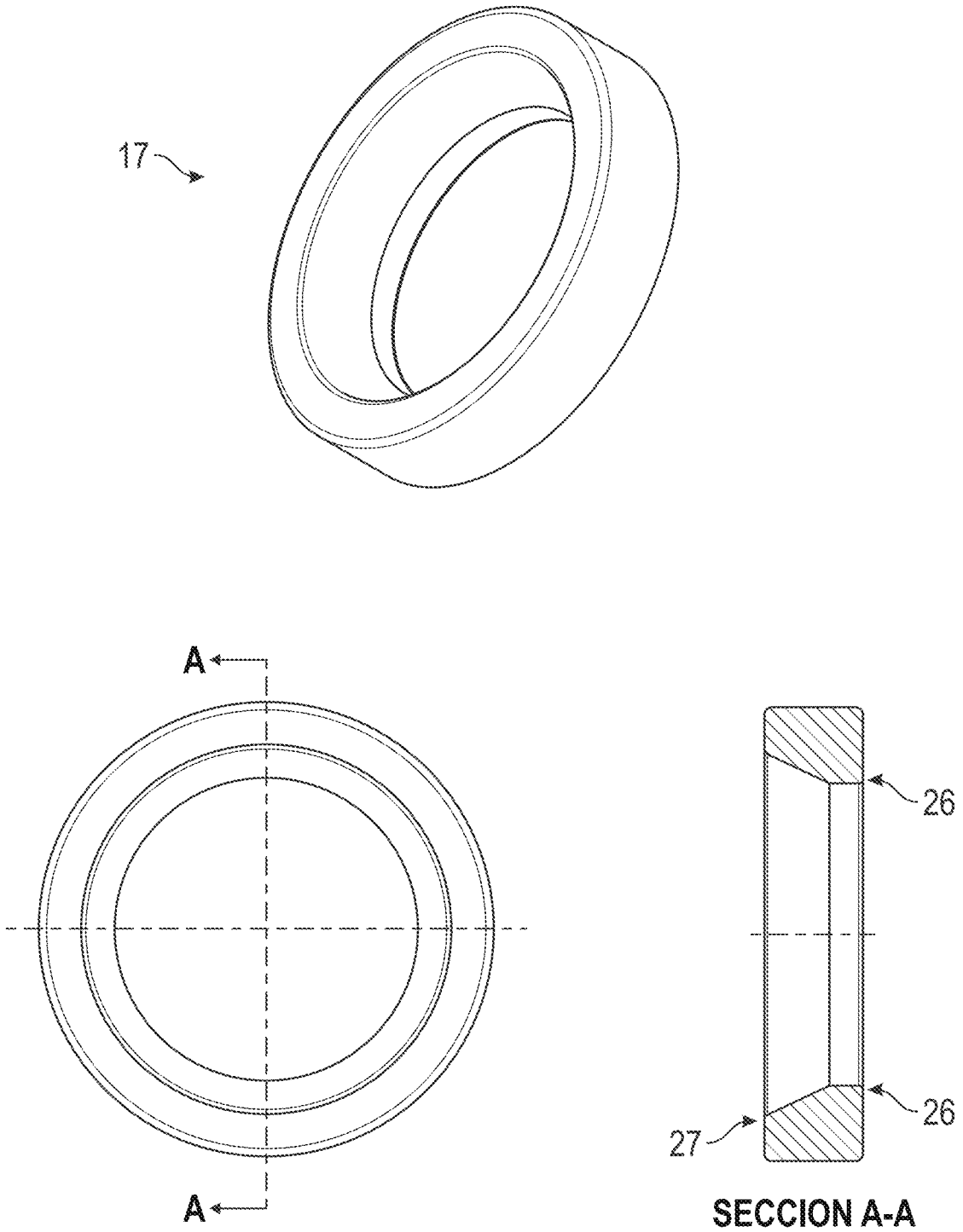
FIG. 9 is an isometric view of the upper spacer of the present invention, according to a dimensional embodiment thereof.

FIG. 9 illustrates the upper spacer (17), a machined annular component located between the support sleeve (4) and the adapter (10) in the pulse-generating section (A). This spacer (17) is part of the bearing assembly and is intended to transmit axial and radial loads between the carriers, maintain coaxial alignment of the valve assembly, and ensure the structural rigidity of the device during operation.

The body of the spacer (17) has interior flat surfaces perpendicular to its longitudinal axis (26) and rounded edges with transition radius that minimize stress concentrations. Additionally, it incorporates a functional chamfer (27) at its bearing contact edge, designed to prevent both bearing races from making simultaneous contact with the spacer, thereby ensuring proper axial load transmission.

Figure 10:
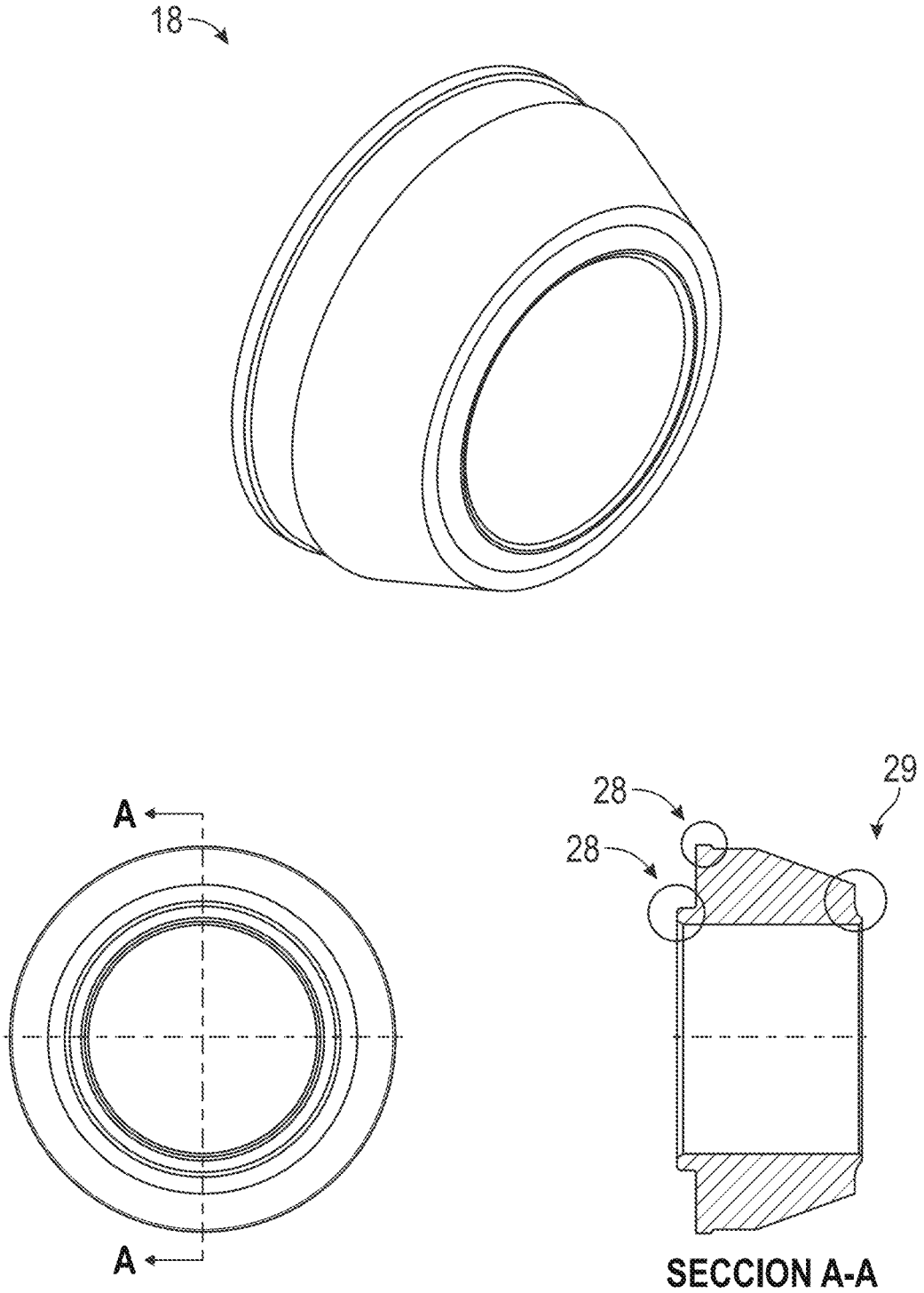
FIG. 10 is an isometric view of the lower spacer of the present invention, according to a dimensional embodiment thereof.

FIG. 10 shows the lower spacer (18), a machined annular body positioned between the support sleeve (4) and the adapter (10) in the pulse-generating section (A). This spacer (18) is also part of the bearing assembly and is designed to ensure continuous transmission of axial and radial loads between adjacent components, maintaining structural rigidity and assembly alignment.

The internal geometry of this spacer (18) features a constant inner diameter to accommodate within it the external cavity of the frustoconical adapter (10). The external surface has a frustoconical shape that allows contact exclusively with the inner race of the downstream bearing, ensuring correct load transfer without structural interference.

It also includes centering grooves (29) that facilitate coupling with adjacent components and ensure proper alignment in the axial assembly of the device.

Figure 11:
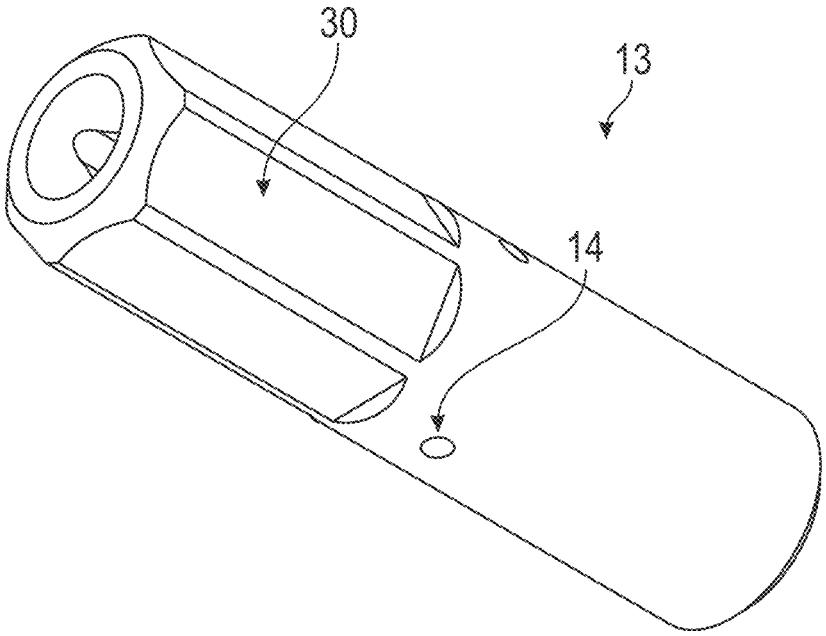
FIG. 11 is a sectional and detailed isometric view of the bypass coupling of the present invention, according to a dimensional embodiment thereof.
Figure 11:
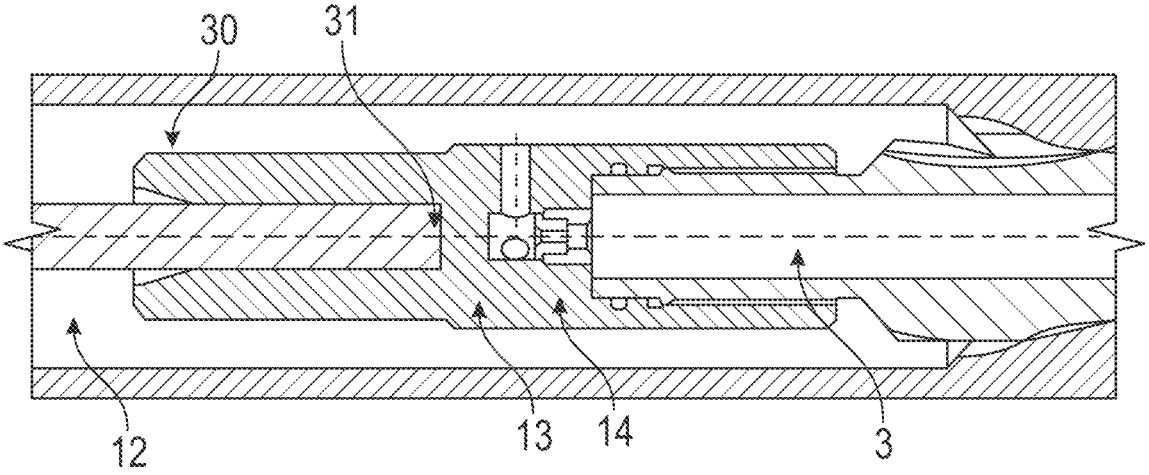

FIG. 11 illustrates, in sectional and isometric detail, the bypass coupling (13), a tubular component that connects the flexible shaft (12) with the drive section (B). This coupling (13) also serves to channel part of the flow into the interior of the rotor of the Moineau motor (3) through the bypass nozzle (14), regulating the rotational speed according to the diverted flow rate.

The external surface of the coupling (13) features six equally spaced radial flats (30) at 60° intervals, facilitating assembly with tightening tools. The lower end (31) is machined either flat-bottomed or with a pilot point, depending on configuration requirements.

Figure 12:
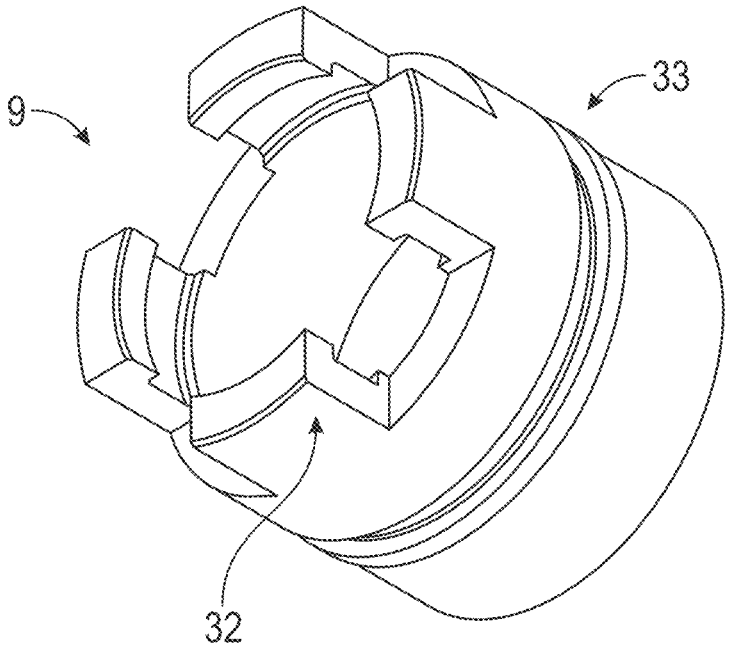
FIG. 12 is an isometric view of the upper carrier of the present invention, according to a dimensional embodiment thereof.
Figure 12:
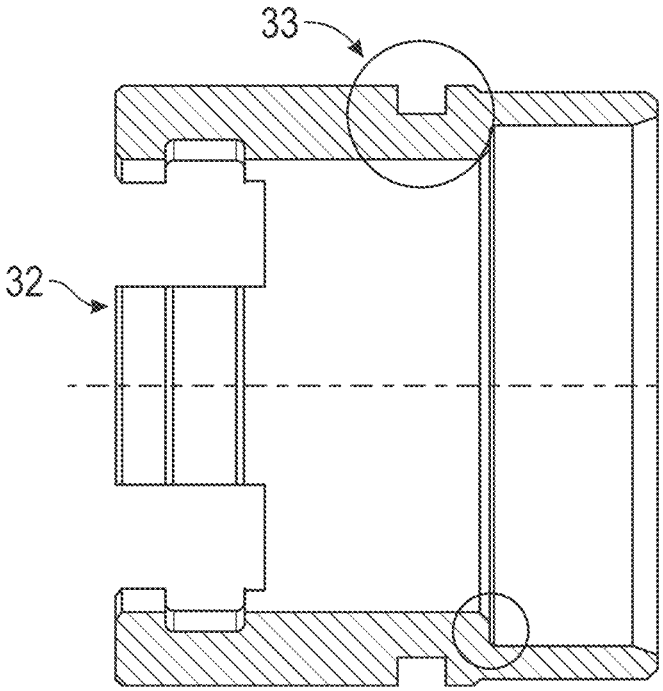

FIG. 12 shows the upper carrier (9), a machined cylindrical component forming part of the support system for the stationary valve (2) in the pulse-generating section (A). This part has a stepped geometry with multiple functional diameters, designed to fit precisely within the support sleeve (4) and ensure its correct axial positioning.

It incorporates milled profiles (32) that provide a castellated shape at the upper end, specifically designed to engage with the castellations machined into the lower end of the upper adapter (5), ensuring angular locking between the two parts. This arrangement allows the carrier (9) longitudinal movement while preventing it from rotating inadvertently under the motion of the rotary valve (1) during operation. The design also includes chamfers and transition radii that minimize stress concentrations, improving structural performance under cyclic loading.

In its midsection, an annular groove (33) is provided for housing an O-ring, ensuring effective hydraulic sealing between the carrier (9) and the support sleeve (4) and preventing internal leakage during operation.

Figure 13:
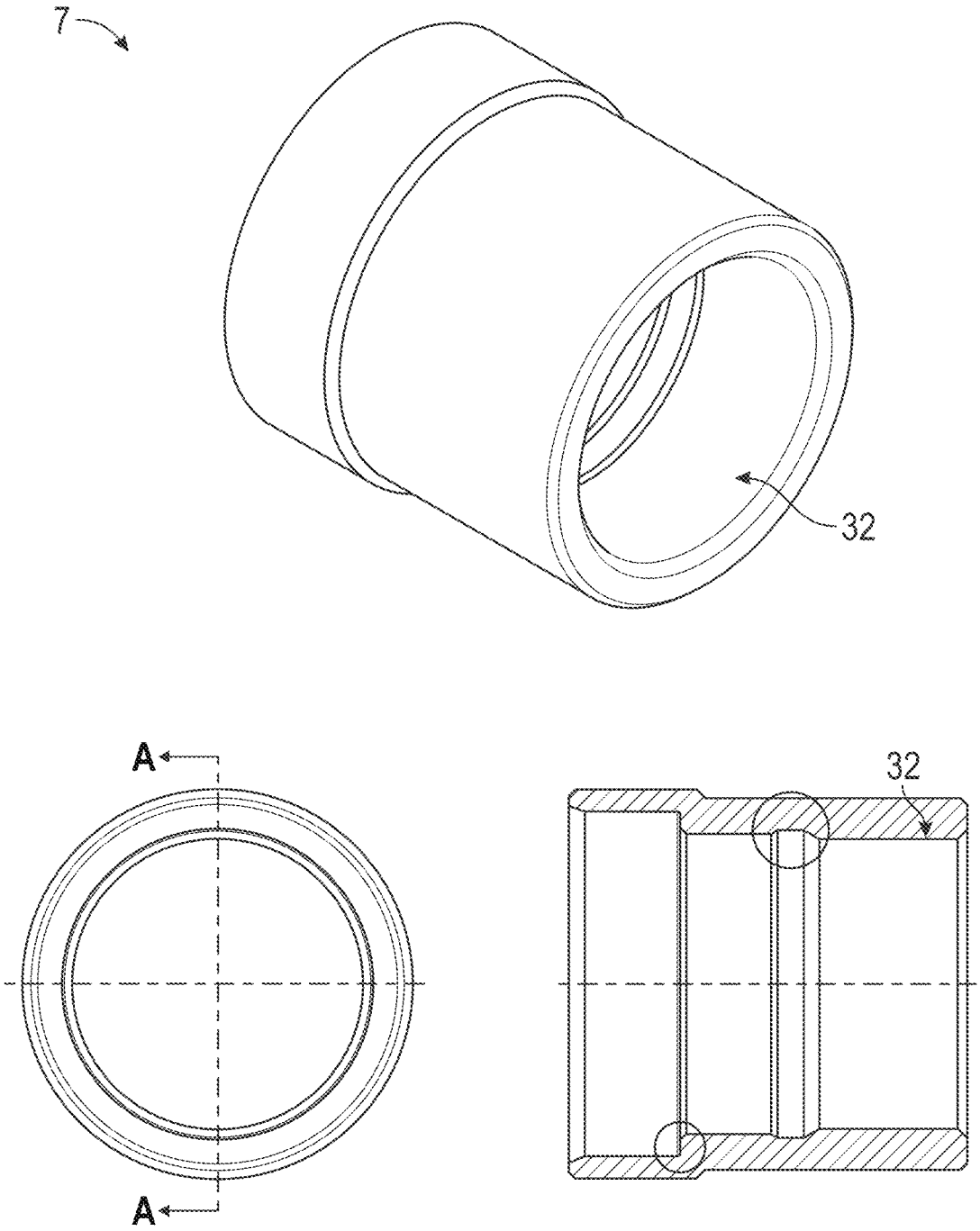
FIG. 13 is an isometric view of the lower carrier of the present invention, according to a dimensional embodiment thereof.

FIG. 13 illustrates the lower carrier (7), a precision-machined annular component designed to house the rotary valve (1) and transmit rotation from the adapter (10). This component includes an internal thread (32) at its distal end for connection to the adapter (10). At its proximal end, it features an interference-fit cylindrical seat for mounting the rotary valve (1), typically made of tungsten carbide or an equivalent material. This configuration secures the axial positioning of the valve (1) without additional fastening elements, maintaining its position during operation of the valve assembly.

Its internal geometry is designed to ensure axial centering of the valve (1) and proper load distribution on the bearings. The structural robustness of the lower carrier (7) enables it to withstand the combined loads generated during operation, contributing to overall rigidity and guiding the rotating system at its end closest to the drive section (B).

Figure 14:
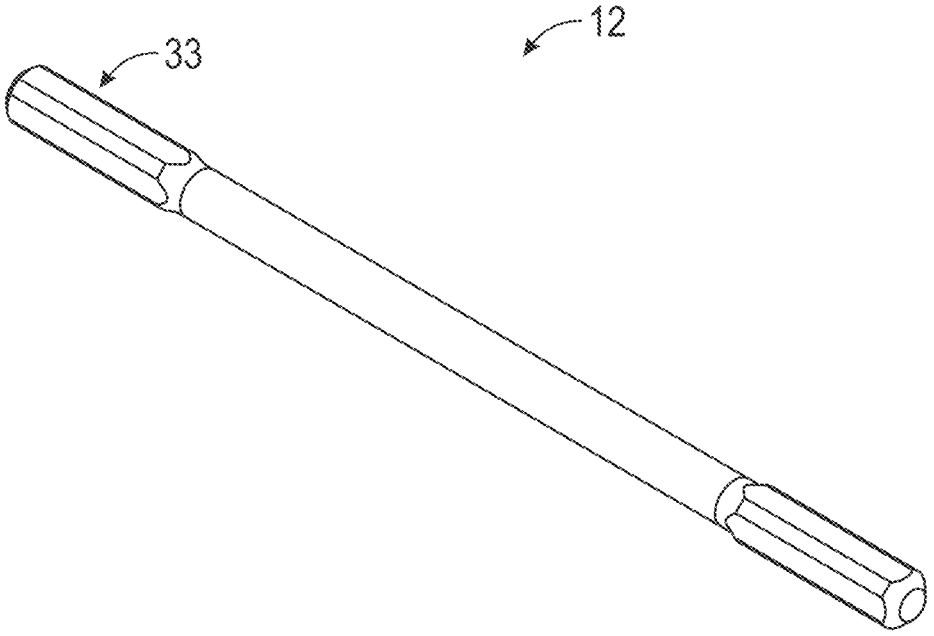
FIG. 14 is an isometric view of the flexible shaft of the present invention, according to a dimensional embodiment thereof.

FIG. 14 illustrates the flexible shaft (12), a component that acts as the transmission shaft between the drive section (B) and the rotary valve (1) of the pulse-generating section (A). The shaft (12) consists of an elongated body with prism-shaped ends having hemispherical tips (33), which engage in prism-shaped hemispherical cavities with a square base (11) located in the adapter (10) and in the bypass coupling (13), allowing limited angular and axial freedom. The midsection of the shaft (12) has a gradual diameter reduction to provide torsional flexibility and geometric adaptability to minor misalignments, without compromising torque transmission capacity. This design optimizes the dynamic behavior of the system and improves its durability under cyclic loading conditions.

The invention claimed is:

1. A hydraulic pulse generator integrated into a downhole motor, comprising a unified tubular body, a power section with a positive displacement Moineau-type hydraulic motor, a bearing section, and a pulse-generating section arranged coaxially and upstream of the power section, all interconnected by a flexible shaft, in which the concentric, face-to-face arrangement of a rotary valve and a stationary valve, driven directly by the flexible shaft, produces a variable fluid passage, thereby generating hydraulic pulses, wherein the pulse-generating section comprises a stationary valve housed within an upper carrier, facing a rotary valve mounted concentrically and fixedly in a lower carrier, the rotary valve being located downstream of the stationary valve, wherein the rotary valve is directly connected to the flexible shaft through an intermediate adapter, such that the valves remain face-to-face and rotate concentrically relative to each other, being driven by the flexible shaft without interposition of intermediate moving elements, forming a coaxial, compact, and structurally integrated assembly, and wherein the rotary valve includes a set of through-holes of circular section distributed radially around a central bore, while the stationary valve comprises a through-opening of polygonal contour open to its periphery and a central bore aligned with the central bore of the rotary valve, the valves being planar elements arranged in direct axial contact with each other, with their through-holes oriented axially through a thickness of each valve, such that flow modulation is performed exclusively by axial overlap of openings through a planar interface, active surfaces of both valves being maintained without relative eccentric movement thanks to flexibility of the shaft and bearing section, without incorporating external parallel flow paths or additional vortex chambers.

2. The hydraulic pulse generator integrated into a downhole motor, according to claim 1, further comprising an intermediate adapter linking the rotary valve to the flexible shaft, wherein the intermediate adapter is formed by a tubular body provided with an external thread at one of its ends, a drive plane adjacent to the thread, a series of lateral circulation ports distributed radially along its side wall, and a prismatic cavity at its opposite end.

3. The hydraulic pulse generator integrated into a downhole motor, according to claim 1, further comprising a set of radial and axial bearings arranged in the bearing section, wherein the set includes an upper spacer and a lower spacer, both formed as machined annular bodies with flat internal surfaces and geometry adapted for axial and radial contact with the adjacent bearings, the lower spacer further having a frustoconical outer surface and centering grooves.

4. The hydraulic pulse generator integrated into a downhole motor, according to claim 1, further comprising a flexible shaft arranged axially between the pulse-generating section and the power section, wherein the flexible shaft is formed by an elongated body whose ends have prismatic heads of square base with hemispherical termination, and whose midsection has a progressively reduced diameter, the heads being configured to fit into complementary cavities of end components, without requiring integral threads or bolted joints.

5. The hydraulic pulse generator integrated into a downhole motor, according to claim 1, further comprising a bypass coupling arranged between the flexible shaft and the power section, wherein the bypass coupling is formed by a tubular body provided with a series of radial millings uniformly distributed over its outer surface and a bypass nozzle machined at one of its ends.

6. The hydraulic pulse generator integrated into a downhole motor, according to claim 5, further comprising a bypass nozzle associated with the bypass coupling, wherein the bypass nozzle is formed by a through-bore machined coaxially in one end of the bypass coupling and having a calibrated internal diameter.

7. The hydraulic pulse generator integrated into a downhole motor, according to claim 1, further comprising a support sleeve that houses and coaxially aligns a valve assembly, wherein the support sleeve is formed by a tubular body having an internal thread at its proximal end and an external thread at its distal end, its interior comprising a calibrated cylindrical cavity configured to coaxially house the carriers and further provided with seats for sealing elements.

8. The hydraulic pulse generator integrated into a downhole motor, according to claim 1, wherein the upper carrier has a stepped geometry with millings at its upper end configured in a castellated form for angular engagement with an upper adapter, and an annular groove for seal accommodation, whereas the lower carrier has an internal thread at its distal end and a machined cylindrical interference fit seat for axial fixation of the rotary valve.

9. The hydraulic pulse generator integrated into a downhole motor, according to claim 8, further comprising an upper adapter arranged at a proximal end of the support sleeve, wherein the upper adapter is formed by a tubular body provided at its lower end with an external thread for coupling with the support sleeve, and at its upper end with a series of radially arranged castellated millings for angular engagement with the millings of the upper carrier.

* * * * *